US009420938B2

(12) United States Patent
Forst et al.

(10) Patent No.: US 9,420,938 B2
(45) Date of Patent: Aug. 23, 2016

(54) DISHWASHER WITH SPRAY DEVICE HAVING AN ADJUSTABLE NOZZLE

(75) Inventors: Klaus-Martin Forst, Peterswoerth (DE); Hansjoerg Lampe, Nuremberg (DE)

(73) Assignee: Electrolux Home Products Corporation N.V., Brussels (BE)

( * ) Notice: Subject to any disclaimer, the term of this patent is extended or adjusted under 35 U.S.C. 154(b) by 550 days.

(21) Appl. No.: 13/885,609

(22) PCT Filed: Nov. 7, 2011

(86) PCT No.: PCT/EP2011/069543
§ 371 (c)(1),
(2), (4) Date: Jul. 17, 2013

(87) PCT Pub. No.: WO2012/065873
PCT Pub. Date: May 24, 2012

(65) Prior Publication Data

US 2014/0150831 A1 Jun. 5, 2014

(30) Foreign Application Priority Data

Nov. 15, 2010 (EP) ..... 10014605

(51) Int. Cl.
*A47L 15/42* (2006.01)

(52) U.S. Cl.
CPC ..... *A47L 15/4282* (2013.01); *A47L 15/4289* (2013.01)

(58) Field of Classification Search
CPC ..... A47L 15/4278; A47L 15/428; A47L 15/4282; A47L 15/4289
See application file for complete search history.

(56) References Cited

U.S. PATENT DOCUMENTS

| | | | | |
|---|---|---|---|---|
| 2006/0087395 | A1* | 4/2006 | Bargholtz | F16K 31/002 337/14 |
| 2006/0108454 | A1 | 5/2006 | Eichholz | |
| 2006/0237044 | A1* | 10/2006 | Ferguson | A47L 15/0049 134/34 |
| 2006/0249181 | A1* | 11/2006 | Wetzel | A47L 15/4221 134/25.1 |

FOREIGN PATENT DOCUMENTS

| | | | |
|---|---|---|---|
| CN | 101865015 | A | 10/2010 |
| DE | 33 30 537 | A1 | 3/1985 |
| DE | 199 47 324 | A1 | 4/2001 |
| EP | 1 334 687 | B1 | 8/2003 |
| EP | 1 586 264 | A2 | 10/2005 |
| GB | 2 199 734 | A | 7/1988 |
| WO | WO 2010/069508 | A1 | 6/2010 |

OTHER PUBLICATIONS

Machine Translation EP1334687 by Steiner (Aug. 13, 2003).*
Machine Translation DE19947324 by Jerg (Apr. 5, 2001).*
(Continued)

*Primary Examiner* — Jason Ko
*Assistant Examiner* — Spencer Bell
(74) *Attorney, Agent, or Firm* — Alston & Bird LLP

(57) ABSTRACT

The present invention relates to a dishwasher comprising at least one spray device (20), the spray device having at least one nozzle (10) for discharging washing liquid in the form of a spray jet, where at least one nozzle is adjustable in order to change the characteristics of the spray jet. According the invention the adjustable nozzle (10) is adjustable by an adjusting means comprising a thermal actuator (10, 60).

25 Claims, 2 Drawing Sheets

(56) References Cited

OTHER PUBLICATIONS

Figure 1:
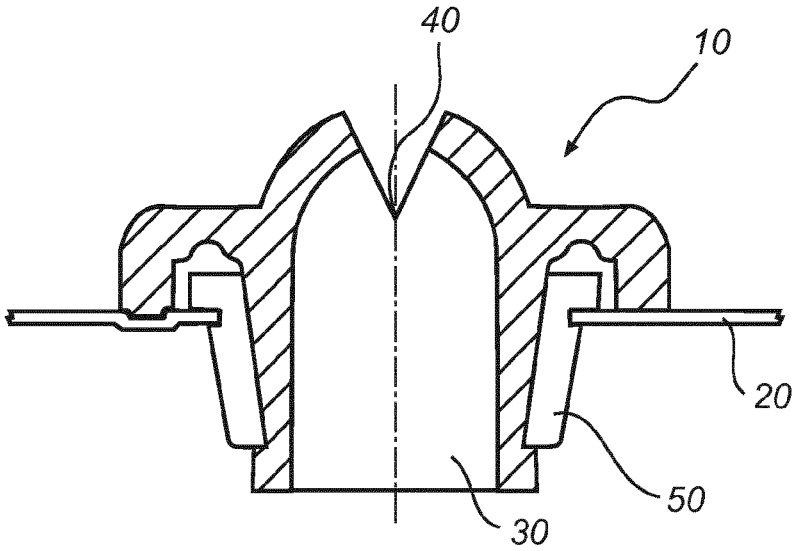

International Searching Authority, International Search Report for International Application No. PCT/EP2011/069543, mailed May 15, 2012, 5 pages total, European Patent Office, The Netherlands.
The State Intellectual Property Office of The P.R.C., Notification of First Office Action for Application No. 201180054597.2, Jan. 6, 2015, 8 pages, China.

* cited by examiner

DISHWASHER WITH SPRAY DEVICE HAVING AN ADJUSTABLE NOZZLE

CROSS REFERENCE TO RELATED APPLICATIONS

This application is a national stage application, filed under 35 U.S.C. §371, of International Application No. PCT/EP2011/069543, filed Nov. 7, 2011, which claims priority to European Patent Application No. 10014605.9, filed Nov. 15, 2010, both of which are hereby incorporated by reference in their entirety.

The present invention relates to a dishwasher comprising at least one spray device, the spray device having at least one nozzle for discharging washing liquid in the form of a spray jet, where at least one nozzle is adjustable in order to change the characteristics of the spray jet.

Dishwashers known in the art typically comprise spray devices e.g. for spraying items to be washed, the spray devices having spray nozzles for discharging washing liquid. It is also known that such spray nozzles can be adjustable so that the spray characteristics are can be changed. The German patent application DE 33 30 537 A1 discloses a dishwasher where nozzles can be closed manually by means of a closing mechanism. US 2006/0108454 A1 discloses a dishwasher with spray nozzles comprising a spraying opening for generating a spray. An adjusting mechanism is provided for changing the spray characteristics. The adjusting mechanism contains liquid for hydraulically changing the cross-section of the spraying opening direction. It is proposed to use an axis of rotation, a hinge, a lever mechanism or elastically deformable nozzles for changing the spray characteristics. GB 2 199 734 A discloses a dishwasher with rotary spray arms comprising manually adjustable, apertured sliders whereby jets of wash liquid may be selectively directed upwardly through apertures or downwardly through other apertures. These sliders are moved manually. European patent EP 334 687 B1 discloses a dishwasher with adjustable spray nozzles comprising an actuating element which can be displaced or rotated by a user in order to adjust the nozzles.

It is an object of the present invention to provide a dishwasher where a spray characteristics can be adjusted automatically and where the adjustment does not require a complex mechanism.

In accordance with the present invention, the above objects are solved by a dishwasher according to the characterizing part of claim 1. According to the present invention, adjustable nozzles are adjusted by an adjusting means comprising a thermal actuator.

In the following the term "adjustable nozzle" is intended to describe nozzles where the shape of the nozzle itself is adjustable as well as nozzles where an effective cross section of a nozzle outlet can be adjusted by means of a separate movable cover.

A thermal actuator is a device that creates motion induced by a thermal expansion or a change in phase (e.g. liquid to solid or liquid to gaseous) or in shape of an element of the actuator due to a temperature change.

It is an advantage of the present invention that by using such a thermal actuator, an automatic adjustment of the adjustable nozzle or nozzles can be performed very easily and no complex mechanism is necessary. The actuation can be simply induced by a temperature change.

Preferred embodiments of the present invention are defined in the dependent claims.

Preferably, at least one wax motor is used for adjusting the nozzle. A wax motor is an actuator that comprises a wax where the thermal expansion and contraction of the wax in response to temperature changes is used for an actuation. The thermal expansion and/or contraction of the wax is converted into a change of the shape of the nozzle in order to adjust the nozzle.

This can preferably be done by use of a simple mechanical connecting part or a plunger connecting the wax motor with flexible sections (made of soft plastic or rubber) of the nozzle. Alternatively, a wax motor can move a cover element or mask which partially covers the opening of the nozzle.

In an alternative preferred embodiment, a memory material is used as thermal actuator.

Memory materials are materials that have the ability to change from one shape to another shape induced by an external stimulus, such as a temperature change. Typically, such a material "remembers" an original shape to which it returns again after being deformed as soon as a specific heat or temperature is applied. Different types of memory materials can be used to implement the present invention. There are memory metals or alloys and memory polymers which both can be used for making the nozzles of a dishwasher adjustable. On the other hand different types of memory effects are known. Some materials can be manufactured in an original, first shape. As long as the memory material is in its cold state, i.e. below its transition temperature, the material can be bent or stretched and will hold those shapes until heated above the transition temperature. Upon heating, the shape changes to its original. Also so-called two-way shape memory materials are known, where the material remembers two different shapes, one at low temperatures and one at the higher temperature. Elements made of such a material that shows a shape memory effect during both heating and cooling can be obtained without the application of external force. All these types of memory effect materials can in principle be used in order to implement the present invention.

Preferably, the memory material of the present invention is a material that reversibly changes the shape when a transition temperature is exceeded. Hence, by means of the temperature, which typically is the temperature of a washing liquid, the shape of the nozzles can be adjusted or adapted to a specific washing step or washing program running at the typical temperature. In a preferred embodiment of the present invention a material is used which has a transition temperature above 20° C. The related temperatures are the temperatures usually used in dishwashers which are up to 75° C. Hence, by selecting a specific transition temperature the nozzle adjustment can be done in a way so as to support the different tasks of a specific washing program. By means of the transition temperature in the range or above 20° C. one can e.g. perform an adjustment of the nozzles as soon as the washing liquid is started to be heated. The transition temperature can also be selected in a way so that the temperature range of 40-55° C. is addressed where in this so-called "bio-phase" the enzymes (e.g. Lipase and Protease) are supported. A higher temperature range starts at 55 C. and typically goes up to about 75° C. where the effect of the bleaching agents is supported.

In one preferred embodiment of the present invention at least one adjustable nozzle is usable for spraying items to be cleaned. Hence, the change of the characteristics of the spray jet is used to vary the way how the items to be cleaned, like dishes, are sprinkled with water. In another preferred embodiment at least one adjustable nozzle is usable for rinsing a detergent out of a detergent chamber. Advantageously such a nozzle used for rinsing out the detergent from the detergent chamber can be closed at higher temperatures (after the detergent is washed out) and so higher spray pressure can be provided to the nozzles for spraying the dishes which improves the cleaning performance provided that the pump rate of a circulation pump remains the same.

In a further embodiment of the present invention the adjusting means comprising the memory material is designed to change a cross-section of the opening of the adjustable nozzle. Such an adjustable nozzle can even be opened or closed completely. In an alternative embodiment the adjusting means can be designed so as to change the opening direction of the adjustable nozzle. With both ways of implementation of the present invention the characteristics of the spray jet by means of the memory material can be made dependent from the temperature of the washing liquid.

Typically, such a spray device comprises at least one spray arm carrying the adjustable nozzles and being designed so as to be rotatable during the washing process.

In a further preferred embodiment the speed of rotation of such a spray arm can also be adjusted by means of adjustable nozzles since—as with the other embodiments—the impetus of the ejected washing liquid can be controlled with respect to the direction at the absolute value.

It is also possible to arrange several nozzles in nozzle groups and to close or open whole groups of nozzles. Hence, although the cumulated open nozzle area remains approximately the same, different areas of a basket and therefore of dishes can subsequently be loaded with a water jet without the need of a higher water flow and therefore without the need of a higher water consumption. Another possibility to reach a bigger area with fewer nozzles is to change the direction or shape of the nozzles over the temperature so that different areas are loaded with the jet at different angles related to different temperatures.

In currently known dishwashers sometimes specific spray arms are used to clean edges of the tub. In such known solutions these arms are supplied and run during the whole program. Here the inventive concept can be used to drive them only at the end of phases with high temperatures especially at the end of the program in the hot rinse.

In case of hard soils typically programs with high temperatures are used which provide for an intensive cleaning. According to the present invention during such a higher temperature program additional nozzles can be opened to have a more intensive cleaning.

On the other hand softer programs usually use lower temperatures. During such a lower temperature phase the nozzle shape or opening can remain wider. Therefore less mechanical impact is induced.

In further preferred embodiments the direction of the adjustable nozzles can be changed in a way such that a spray spot is generated within the washing tub (e.g. in main wash with higher temperature) or a wider spray can be generated to wet or soak a bigger area (e.g. in pre-wash). Such a forming of the spray characteristics can also be achieved by switching off or switching on specific groups of nozzles (without changing the direction of opening of a specific nozzle).

The adjustment of the nozzle can be performed via the adjusting means comprising a memory material or a wax motor acting like a switch or switch blade element covering or re-opening the cross-section of the nozzle opening partially or completely. Hence, the adjustable nozzle itself can be made or can comprise sections of the memory material such that the adjusting means is integrally formed into the nozzle itself such that the nozzle shape itself changes as soon as the temperature crosses the transition temperature of the memory material.

Alternatively, a nozzle made of an elastic material or comprising sections of such an elastic material can be deformed and hence adjusted by one or more wax motors in order to change the effective cross section and/or a direction of the nozzle opening. The dishwasher can be in direct mechanical contact with the adjustable nozzle or can be connected to the adjustable nozzle by means of a mechanical connecting element.

The adjustable nozzles according to the present invention can be part of a complete spray arm e.g. molded together with the spray arm, or can be inserted in the spray arm e.g. glued, welded, clipped.

Figure 2:
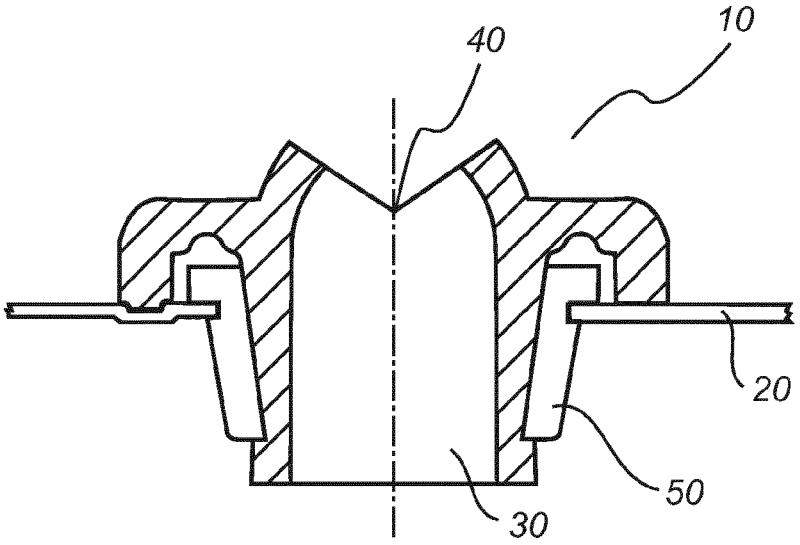
Figure 3:
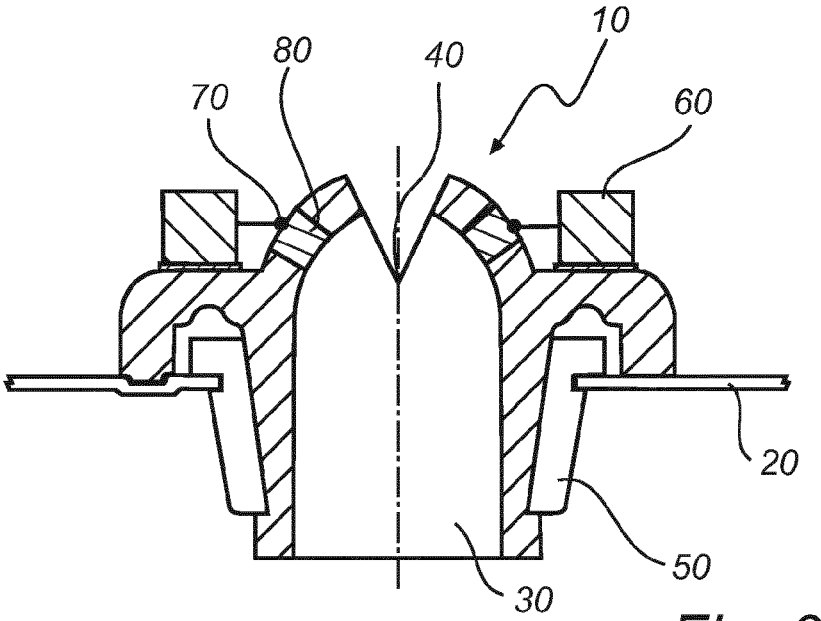
Figure 4:
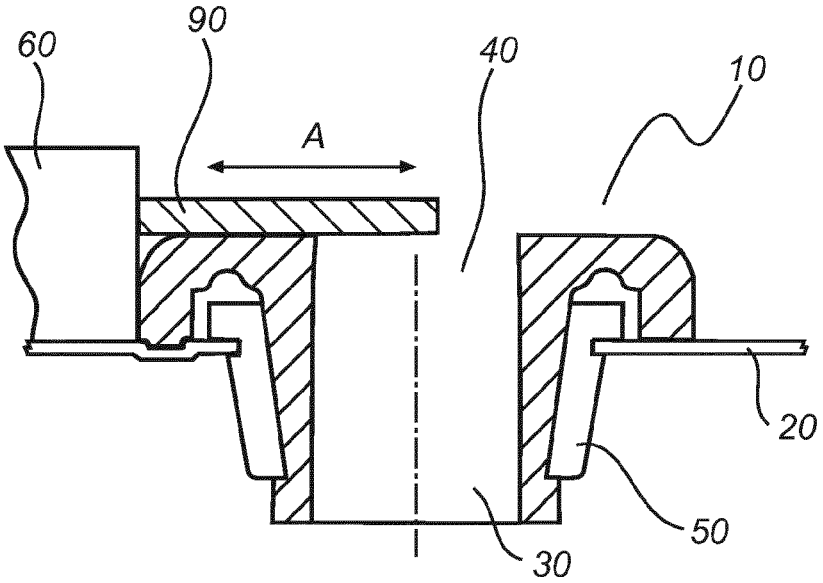

Further preferred embodiments of the invention will be described below by reference to the drawings, in which:

FIG. 1 is a schematic cross section of an adjustable spray nozzle of a dishwasher at a first temperature, where, according to the present invention, the nozzle is adjusted to have a narrow opening;

FIG. 2 shows the spray nozzle FIG. 1 at a second temperature, where the nozzle by means of a thermal actuator is adjusted to have a wider opening, FIG. 3 is a schematic cross section of an adjustable spray nozzle of a dishwasher where, according to the present invention, the nozzle is adjustable by means of two wax motors, and FIG. 4 is a schematic cross section of an adjustable spray nozzle of a dishwasher where the opening of the nozzle can be covered by means of a wax motor.

FIGS. 1 and 2 shows a conical nozzle 10 clipped into of a spray arm 20 of a dishwasher by means of fastening element 50. Nozzle 10 comprises an inlet 30 for receiving a washing liquid and an outlet 40 for ejecting the liquid as a spray. Nozzle 10 is made of a memory material which is transferred from a first predefined shape as shown in FIG. 1 to a second predefined shape as shown in FIG. 2 when a specific transition temperature is overstepped. Depending on the needs of applied washing programs the cross section of the nozzle 10 is hence more opened or more closed (or alternatively the direction the opening and hence of the jet could be varied) depending on the temperature where the first temperature (FIG. 1) could be in the range of 20° C. and the second temperature (FIG. 2) in the range of 60° C. or vice versa. The according transition temperature is hence between 20 and 60° C. By rather closing nozzle 10 (and also further adjustable nozzles), the pressure of the spray jets of the remaining nozzles (not shown) will increase. That means that less surface of the dishes is loaded with the jet but the respective jet has a higher impact. If in turn nozzle 10 is opened the pressure decreases but the higher water flow reaches more surface and is more able to transport soil.

FIG. 3 schematically shows an adjustable conical nozzle 10 where a nozzle opening 40 is adjustable by means of two wax motors 60. Each wax motor is connected to a pivot section 80 of nozzle 10 by means of a plunger 70. Nozzle 10 is made of a flexible material like rubber or plastic. Alternatively, nozzle 10 could comprise flexible sections. Preferably, nozzle opening 40 is formed as a slit so that the opening can be easily opened or closed through the two wax motors 60 acting on both sides of the slit or one wax motor acting on one side. Any change of the temperature around the wax motors 60, e.g. any change of the temperature of the washing liquid induces a thermal expansion or contraction of a wax included in the wax motors 60 which in turn causes the plungers 70 to deform the flexible nozzle 10 so as to change the cross section of the nozzle opening 40.

In the embodiment of FIG. 4, an opening 40 of a nozzle 10 can be partially covered by means of a mask or cover or blade 90 which is moved by a wax motor 60 in direction "A" so as to change the effective cross section of the opening 40 by partially covering and closing it. The opening 40 (beyond the mask 90) can have any cross section. Preferably opening 40 is a slit along direction "A". In contrast to the embodiment of FIG. 3, no specific requirements with respect to the flexibility of the nozzle material need to be fulfilled since no deformation of the nozzle 10 itself is necessary.

The invention claimed is:

1. Dishwasher comprising at least one spray device, the spray device having a number of nozzles for discharging washing liquid in the form of a spray jet, where at least one nozzle of the number of nozzles is adjustable in order to change the characteristics of the spray jet, wherein the at least one adjustable nozzle is adjustable by an adjusting means comprising a thermal actuator, wherein the at least one adjustable nozzle comprises a flexible material;

wherein the at least one adjustable nozzle is deformable such that the at least one adjustable nozzle is configured to change the characteristics of the spray jet by deforming the flexible material, and wherein the thermal actuator is mechanically connected to the adjustable nozzle, such that the thermal actuator is configured to deform the adjustable nozzle to change the characteristics of the spray jet.

2. The dishwasher of claim 1, wherein the thermal actuator is a wax motor.

3. The dishwasher of claim 2, wherein the wax motor is in direct mechanical contact with the adjustable nozzle or is connected to the adjustable nozzle by means of a mechanical connecting element.

4. The dishwasher of claim 1, wherein the thermal actuator is a memory material, preferably a memory metal or a memory polymer.

5. The dishwasher of claim 4, wherein the memory material is a material that reversibly changes shape when a transition temperature is exceeded.

6. The dishwasher claim 5, wherein the transition temperature is above 20° C.

7. The dishwasher claim 5, wherein the transition temperature is above 40° C.

8. The dishwasher claim 5, wherein the transition temperature is between 55° C. and 75° C.

9. The dishwasher of claim 1, wherein at least one adjustable nozzle is usable for spraying items to be cleaned.

10. The dishwasher of claim 1, wherein at least one adjustable nozzle is usable for rinsing a detergent out of a detergent chamber.

11. The dishwasher of claim 1, wherein the adjusting means is configured to change the cross section of the opening of the at least one adjustable nozzle by reversibly changing the shape of the nozzle.

12. The dishwasher of claim 1, wherein the adjusting means is configured to change the opening direction of the at least one adjustable nozzle.

13. The dishwasher of claim 1, wherein the adjusting means is configured to change the characteristics of the spray jet by means of the thermal actuator and depending on the temperature of a washing liquid.

14. The dishwasher of claim 1, wherein the spray device comprises at least one spay arm carrying the at least one adjustable nozzle, wherein the at least one spray arm is rotatable during a washing process, and wherein the speed of rotation of the spray arm is adjustable by means of the at least one adjustable nozzle.

15. Dishwasher comprising at least one spray device, the spray device having a number of nozzles for discharging washing liquid in the form of a spray jet, where at least one nozzle of the number of nozzles is adjustable in order to change the characteristics of the spray jet, wherein the at least one adjustable nozzle is adjustable by an adjusting means comprising a thermal actuator, wherein the thermal actuator comprises a memory material, wherein the memory material is a material that reversibly changes shape in response to a change in temperature, and wherein the adjustable nozzle is made at least partially of the memory material such that the adjusting means is integrally formed into the nozzle.

16. The dishwasher of claim 15, wherein the memory material comprises a memory metal or a memory polymer.

17. The dishwasher of claim 15, wherein the memory material is a material that reversibly changes shape when a transition temperature is exceeded.

18. The dishwasher claim 17, wherein the transition temperature is above 20° C.

19. The dishwasher claim 17, wherein the transition temperature is above 40° C.

20. The dishwasher claim 17, wherein the transition temperature is between 55° C. and 75° C.

21. The dishwasher of claim 15, wherein at least one adjustable nozzle is usable for rinsing a detergent out of a detergent chamber.

22. The dishwasher of claim 15, wherein the adjusting means is configured to change the cross section of the opening of the adjustable nozzle by reversibly changing the shape of the nozzle.

23. The dishwasher of claim 15, wherein the adjusting means is configured to change the opening direction of the adjustable nozzle.

24. The dishwasher of claim 15, wherein the adjusting means is configured to change the characteristics of the spray jet by means of the thermal actuator and depending on the temperature of a washing liquid.

25. The dishwasher of claim 15, wherein spray device comprises at least one spay arm carrying the adjustable nozzles, wherein the at least one spray arm is rotatable during a washing process, and wherein the speed of rotation of the spray arm is adjustable by means of the adjustable nozzles.

* * * * *